United States Patent [19]

Chamberlin

[11] 4,033,511

[45] July 5, 1977

[54] PORTABLE ATOMIZER APPARATUS

[76] Inventor: Edward B. Chamberlin, 112 Fifth St., Garden City, N.Y. 11530

[22] Filed: Nov. 24, 1975

[21] Appl. No.: 634,660

[52] U.S. Cl. ..... 239/346; 222/383; 239/351; 239/355

[51] Int. Cl.[2] ..... B05B 7/30

[58] Field of Search ..... 239/332, 346, 351, 355; 222/193, 333, 383, 385

[56] References Cited

UNITED STATES PATENTS

| | | | |
|---|---|---|---|
| 1,881,570 | 10/1932 | Hermann | 239/351 X |
| 2,629,539 | 2/1953 | Drewes, Jr. | 239/351 X |
| 2,999,646 | 9/1961 | Wagner | 239/332 |
| 3,173,584 | 3/1965 | Giavasis | 222/385 X |
| 3,901,449 | 8/1975 | Bochmann | 239/332 |

*Primary Examiner*—John J. Love
*Assistant Examiner*—Andres Kashnikow
*Attorney, Agent, or Firm*—Brumbaugh, Graves, Donohue & Raymond

[57] ABSTRACT

A portable atomizer includes a liquid dispenser, a reciprocating pump for supplying compressed air to the dispenser, and a motor for driving the pump. Upon operation of the motor, compressed air is delivered directly to the dispenser from the pump to automatically atomize liquid in the dispenser and instantaneously spray atomized liquid and compressed air from an orifice in the dispenser.

1 Claim, 3 Drawing Figures

FIG. 1
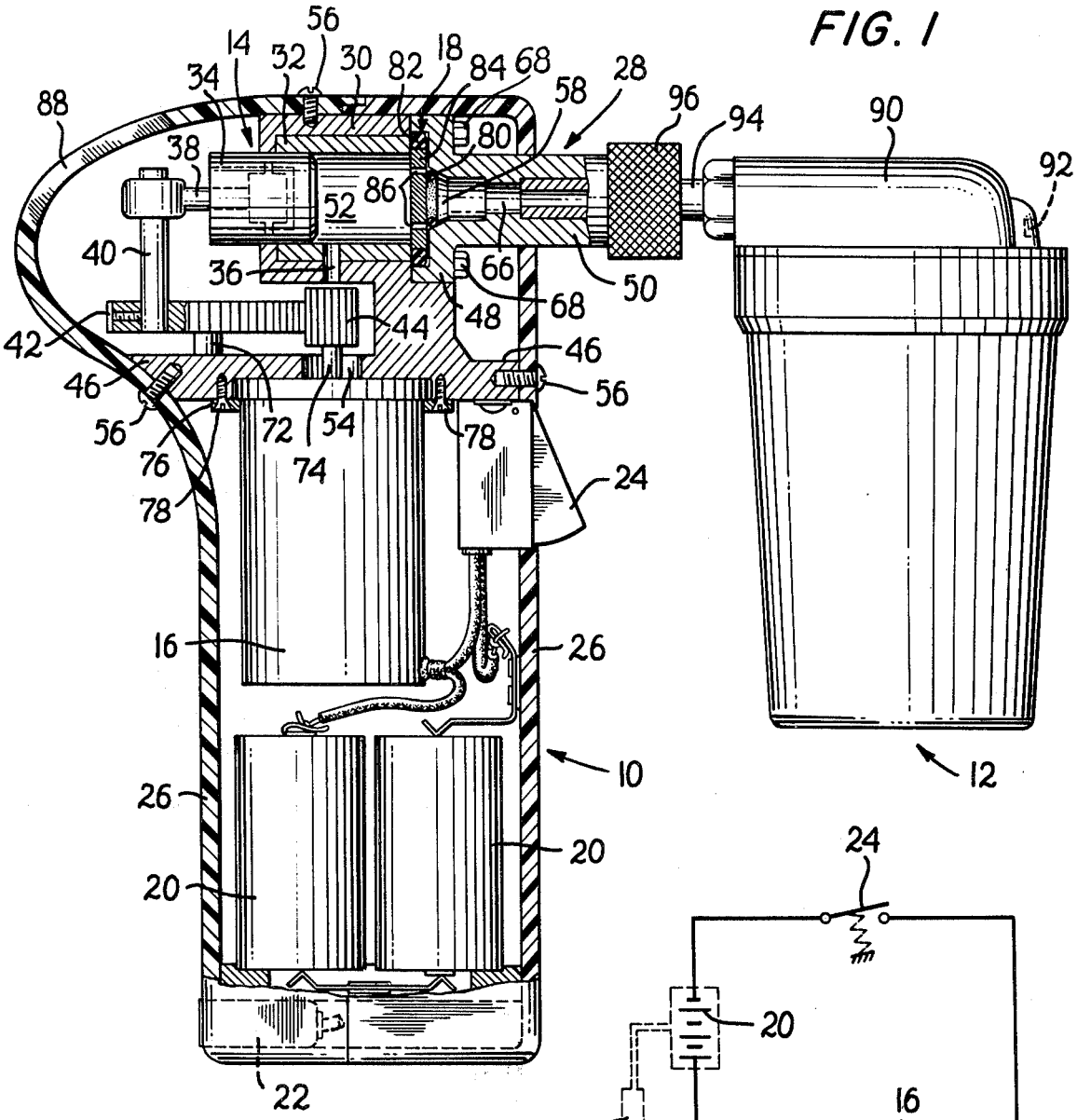
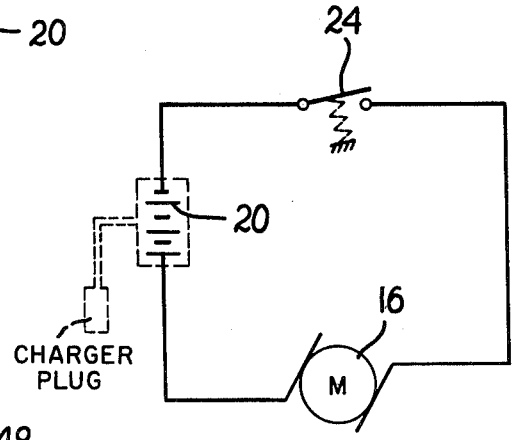
FIG. 3
FIG. 2
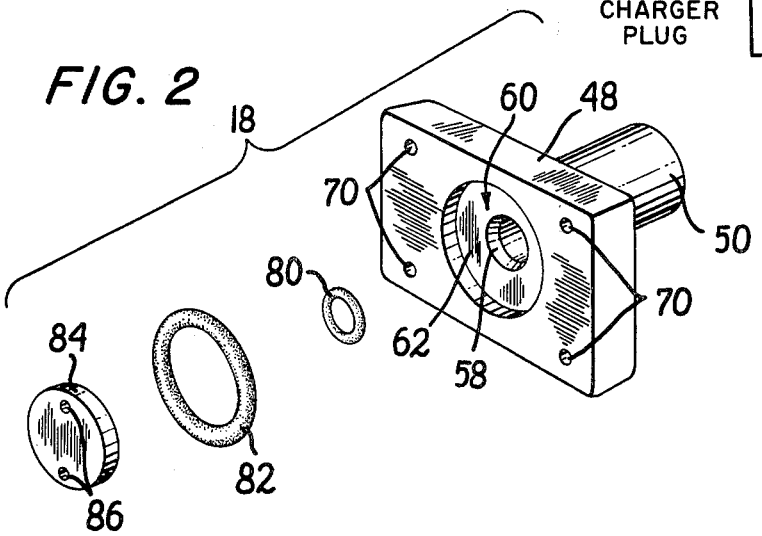

PORTABLE ATOMIZER APPARATUS

The present invention relates to an atomizing apparatus, and, more particularly, to a novel and improved atomizer which includes a portable compressor for atomizing and spraying a liquid contained in a dispenser.

Spraying devices capable of atomizing and spraying a variety of liquids have been known for many years. In my U.S. Pat. No. 3,592,244 there is described an apparatus for charging portable gas-containing flasks adapted for use with such spraying devices. The apparatus includes a compressor driven by an electric motor, the operation of the motor being initiated by a switch engaged by the flask when it is mounted at a charging station of the apparatus. Since the compressor and the motor are contained in a relatively large housing, after the flask is charged with compressed air, the flask must be disengaged from the compressor before being manually actuated for powering the spraying device.

When the supply of compressed air in the flask is depleted, the flask must be recharged. The provision of a rechargeable flask is disadvantageous because it necessitates the utilization of a check valve in the flask to ensure that it remains charged with compressed air after removal from the compressor. Furthermore, in order to provide a portable spraying device, the size and volume of the flask is severely restricted, and therefore only a limited quantity of compressed air can be stored in the flask between chargings. Since the flask contains only a limited quantity of compressed air, the operating life of the spraying device is disadvantageously curtailed, thereby requiring frequent charging of the flask.

In accordance with the present invention, there is provided a novel and improved portable atomizer which includes a liquid dispenser having a spray orifice, a reciprocating pump for directly supplying compressed air to the dispenser through a conduit communicating between the pump and the dispenser, and a motor for driving the pump. Upon operation of the motor, compressed air is delivered directly to the dispenser from the pump to automatically atomize liquid in the dispenser and instantaneously spray atomized liquid and compressed air from the orifice of the dispenser.

Since the compressed air is delivered directly to the dispenser from the pump, the present invention eliminates the necessity of providing a gas-containing flask for storing the compressed air. By eliminating the flask which can store only a limited quantity of compressed air, the operating life of the portable atomizer may be significantly prolonged depending upon the type of motor employed to drive the pump.

The portable atomizer of the present invention may include a coupling for releasably connecting the pump to the dispenser so that a number of dispensers may be employed in any particular operation or operations. A check valve may also be arranged between the pump and the conduit for ensuring that compressed air flows only from the pump to the dispenser.

In one embodiment, the motor is electrically operated and powered by a battery which is electrically connected to the motor. If a rechargeable battery is used, the atomizer may be provided with a charger plug electrically connected to the battery and adapted to receive a converter for recharging the battery. A trigger switch may be electrically connected to the motor and the battery for controlling the operation of the motor.

The motor, rechargeable battery, and charger plug may be housed within a pistol grip-type handle so that the atomizer is easily handled and transported. To enhance the aesthetic appearance of the atomizer, the pump and the check valve may also be housed within the handle, the conduit and the trigger switch extending outwardly from the surface of the handle adjacent the dispenser.

For a more complete understanding of the invention reference may be had to the following detailed description taken in conjunction with the accompanying figures of the drawing, in which:

FIG. 1 is a partial cross sectional view of an exemplary embodiment of the portable atomizer of the present invention;

FIG. 2 is an exploded perspective view of a check valve which forms a part of the atomizer of FIG. 1; and FIG. 3 is a schematic of the electrical circuitry for controlling a motor which drives a reciprocating pump used in the present invention.

In FIG. 1, there is shown a portable atomizer including a compressor 10 adapted to spray liquid from a dispenser 12. The compressor 10 includes a reciprocating pump 14 for directly delivering compressed air to the dispenser 12 and a motor 16 for driving the pump 14. A check valve 18 is positioned at the delivery end of the pump 14 permits compressed air to flow only from the pump 14 to the dispenser 12. The electric motor 16 is powered by rechargeable batteries 20. Preferably, cadmium rechargeable batteries are used. However, any rechargeable battery is suitable as long as it is capable of providing adequate power and cycle time. A charger plug 22 is electrically connected to the batteries 20 and is adapted to receive a converter (not shown) for recharging the batteries 20. A trigger switch 24 is electrically connected to the motor 16 and the batteries 20 for controlling the operation of the motor 16.

As shown, the pump 14, motor 16, check valve 18, batteries 20, charger plug 22, and trigger switch 24 are housed within a pistol grip-type handle 26 which may be made in two parts. The handle 26 is preferably constructed from plastic or any other suitable material capable of forming a shockproof and shatterproof housing.

The pump 14 is located at the upper end of the handle 26 and comprises a pump body 30. The pump body 30 houses a sleeve 32 which forms a cylinder 52, a piston 34 being slidably mounted for reciprocating movement in the cylinder 52. The piston 34 is reciprocated in the cylinder 52 by the motor 16 through driving means including a connecting rod 38 pivotally connected at one end to the piston 34 and at the other end to a crank pin 40 which is eccentrically mounted on a gear 42. The gear 42 is rotatably mounted on a shaft 72 journaled in a mounting block 46 integral with the pump body 30. A worm-type gear 44 mounted on the end of a rotatable shaft 74 of the motor 16 drives the gear 42.

The motor 16 is mounted beneath the mounting block 46 by means of a mounting collar 76 which is secured to the underside of the mounting block 46 by screws 78. The shaft 74 of the motor 16 extends upwardly through an opening 54 in the mounting block 46, which is secured, along with the pump body 30, to the handle 26 by screws 56.

Air is drawn into the handle 26 through a grill 88 in the upper portion of the handle 26. During the expansion stroke of the pump 14, the piston 34 is retracted past a port 36 in the side wall of the pump body 30 and sleeve 32 (see FIG. 1) so that air in the handle 26 is drawn into the cylinder 52 through the port 36. During the compression stroke of the pump 14, the piston 34 moves forwardly in the cylinder 52 and blocks the port 36 so that air in the cylinder 52 is compressed, the compressed air flowing through the check valve 18 into the dispenser 12.

Referring now to FIGS. 1 and 2, the check valve 18 is positioned within a cylinder head 28 having a block portion 48 and a barrel portion 50. The barrel portion 50 is provided with an axial bore 66 therethrough, the rear end of the bore 66 having a forwardly converging frustoconical portion 58 which forms an outer valve seat. The block portion 48 is provided with holes 70 for receiving screws 68 so that the cylinder head 28 may be secured to the pump body 30. A cavity 60, which is provided in the block portion 48 of the cylinder head 28, communicates with the bore 66 in the barrel portion 50.

An O-ring 82 is disposed within the cavity 60, the O-ring 82 having a diameter slightly greater than the depth of the cavity 60 so that it may be compressed between the forward end of the sleeve 32 and a rear wall 62 of the cavity 60. A disk 84 having a thickness somewhat less than the depth of the cavity 60 is disposed in the cavity 60 coaxially therewith. The disk 84 has a diameter equal to or slightly greater than the inner diameter of the O-ring 82 and slightly greater than the inner diameter of the sleeve 32. The disk 84 has apertures 86 therethrough, the apertures 86 being disposed an equal distance from the axis of the disk 84 with their radially outer edges in approximate alignment with the rear outer edge portion of the frustoconical portion 58. A smaller O-ring 80 is held under a slight axial compression in the frustoconical portion 58 to form an inner valve seat.

When the pump 14 is not operating and there is no air pressure in the bore 66, the O-ring 80 constantly thrusts the disk 84 rearwardly into a position whereby its rear edge portion engages a forward end of the sleeve 32. When the air pressure in the bore 66 exceeds that in the cylinder 52, as it does when the piston 34 is being retracted, air in the bore 66 thrusts the O-ring 80 into forceable sealing engagement with the frustoconical portion 58 and the forward surface of the disk 84 (see FIG. 1). However, when the air pressure in the forward end of the cylinder 52 exceeds that in the bore 66, as during the compression stroke of the pump 14, air flows from the cylinder 52 forwardly through the apertures 86 in the disk 84, and hence radially inwardly toward the O-ring 80.

The air flow displaces the O-ring 80 in the vicinity of the apertures 86, thereby forcing the O-ring 80 radially inward away from the frustoconical portion 58 and the apertures 86 so that air flows forwardly into the bore 66. The compressed air passes from the bore 66 into a conduit 94 which communicates with the dispenser 12. When the pressure rearwardly of the check valve 18 is reduced to a value substantially below that forwardly of the check valve 18, it is again sealed against the rearward flow of air, thereby ensuring air flow only from the pump 14 to the dispenser 12.

As shown schematically in FIG. 3, the trigger switch 24 is connected in series with the motor 16 and the batteries 20 to form a motor supply circuit. When the trigger switch 24 is depressed closing the motor supply circuit, the motor 16 is actuated to drive the pump 14. In operation, the pump 14 supplies compressed air directly to the dispenser 12 which includes an aspirator 90 for receiving liquid in the dispenser 12 through a dip tube or similar devices positioned within the dispenser 12. Upon delivery of the compressed air to the dispenser 12, the mixture of atomized liquid and compressed air is sprayed through an orifice 92 in the dispenser 12. A coupling 96 is provided on the barrel portion 50 of the cylinder head 28 to releasably connect the dispenser 12 to the pump 14, whereby a plurality of dispensers containing the same or different liquids may be used interchangeably with the compressor 10.

Thus there is provided, in accordance with the invention, a novel and improved atomizer including a portable compressor which directly supplies compressed air to a dispenser for automatically atomizing liquid in the dispenser and instantaneously spraying atomized liquid and compressed air from the dispenser.

It will be understood that the above described embodiments are merely exemplary and that persons skilled in the art may make many variations and modifications without departing from the spirit and scope of the invention. For example, the electric motor for driving the pump may be operated from an A.C. power source. All such modifications and variations are intended to be included within the scope of the invention as defined in the appended claims.

I claim:

1. A portable atomizer, comprising a liquid dispenser including a cap connected directly to the dispenser, the cap having an aspirator and a spray orifice communicating directly with the aspirator, the orifice being integral with the cap; a pistol grip-type handle housing a reciprocating pump for directly supplying compressed air to the aspirator through a conduit extending outwardly from the surface of the handle adjacent the dispenser and communicating between the pump and the aspirator, a check valve between the pump and the conduit for permitting compressed air to flow only from the pump to the aspirator, an electric motor for driving the pump, a rechargeable battery electrically connected to the motor for powering the motor, a charger plug electrically connected to the battery and adapted to receive a converter for recharging the battery, and a trigger switch extending outwardly from the surface of the handle adjacent the dispenser and electrically connected to the battery and the motor for controlling the operation of the motor, wherein upon operation of the motor compressed air is delivered directly to the aspirator from the pump to immediately draw liquid from the dispenser, automatically atomize liquid drawn from the dispenser and instantaneously spray atomized liquid and compressed air from the orifice; and means for releasably connecting the dispenser to the pump and for permitting the dispenser, cap and spray orifice to be replaced unitarily, whereby a plurality of dispensers containing the same or different liquids may be used interchangeably without cross-contamination from one liquid to another.

* * * * *